US006245723B1

(12) United States Patent
Sigg et al.

(10) Patent No.: US 6,245,723 B1
(45) Date of Patent: Jun. 12, 2001

(54) COOLING LUBRICANT EMULSION

(75) Inventors: Karl Sigg, Diedorf; Hartmut Rieger, Boxberg; Juergen Geke; Wiltrud Klose, both of Duesseldorf, all of (DE)

(73) Assignee: Henkel Kommanditgesellschaft auf Aktien (Henkel KGAA), Duesseldorf (DE)

( * ) Notice: Subject to any disclaimer, the term of this patent is extended or adjusted under 35 U.S.C. 154(b) by 0 days.

(21) Appl. No.: 09/355,533

(22) PCT Filed: Jan. 20, 1998

(86) PCT No.: PCT/EP98/00277

§ 371 Date: Jul. 29, 1999

§ 102(e) Date: Jul. 29, 1999

(87) PCT Pub. No.: WO98/32818

PCT Pub. Date: Jul. 30, 1998

(30) Foreign Application Priority Data

Jan. 29, 1997 (DE) ..... 197 03 085

(51) Int. Cl.[7] ..... C10M 173/00; C10M 177/00

(52) U.S. Cl. ..... 508/315; 508/450; 508/485; 508/486; 508/491; 508/579; 508/591; 72/42

(58) Field of Search ..... 72/42; 508/315

(56) References Cited

U.S. PATENT DOCUMENTS

| | | | | |
|---|---|---|---|---|
| 2,303,142 | | 11/1942 | Spangler | 80/60 |
| 2,425,174 | | 8/1947 | Carmichael et al. | 252/33 |
| 3,298,954 | | 1/1967 | Brown | 252/51.5 |
| 3,429,815 | | 2/1969 | Drake | 252/49.5 |
| 3,444,080 | * | 5/1969 | Berger | 252/49.5 |
| 3,726,799 | * | 4/1973 | McDole et al. | 252/49.5 |
| 4,027,512 | | 6/1977 | Treat | 72/42 |
| 4,202,193 | * | 5/1980 | Wilson | 72/42 |
| 4,237,021 | * | 12/1980 | Andlid et al. | 252/49.5 |
| 4,618,441 | * | 10/1986 | Tsai | 252/49.5 |
| 4,636,323 | | 1/1987 | Makino et al. | 252/51.5 |
| 5,583,100 | | 12/1996 | Okamoto et al. | 508/441 |
| 5,688,749 | * | 11/1997 | Ibuki et al. | 508/486 |
| 5,693,596 | * | 12/1997 | Kaburagi et al. | 508/143 |

FOREIGN PATENT DOCUMENTS 195 25 407 1/1997 (DE) .

OTHER PUBLICATIONS

DIN 51 51385.
Ullmann's Encyclopedia of Industrial Chemistry, 5th Ed., vol.A15, pp. 479–486.
Kuhlschmiermittel Auf Metalloberflachen (1993) pp. 138–142.

* cited by examiner

*Primary Examiner*—Ellen M. McAvoy
(74) *Attorney, Agent, or Firm*—Roylance, Abrams, Berdo & Goodman, L.L.P.

(57) ABSTRACT

A process for preparing a stable cooling lubricant emulsion for use in the cutting of metals involves the steps of (a) forming a mixture having an oil component, water and an emulsifier with the oil component being emulsified in the water, then (b) dispersing into 100 parts by weight of the mixture by means of high shear from about 1 to about 14 parts by weight of a natural, water-immiscible cutting oil. The stable oil-in-water cooling lubricant emulsion formed has at least 50 percent of the cutting oil present in the form of particles having a diameter of 0.5 to 8 $\mu$m. The cooling lubricant emulsion formed may be used in an extended range of applications.

15 Claims, No Drawings

COOLING LUBRICANT EMULSION

BACKGROUND OF THE INVENTION

This application is filed under 35 U.S.C. § 371 and based on PCT/EP98/00277, filed Jan. 20, 1998, now WO 98/32818.

1. Field of the Invention

This invention relates to a new type of cooling lubricant emulsion for the cutting of metals and to a process for the preparation of such an emulsion.

2. Discussion of Related Art

Cooling lubricants are preparations/mixtures which are used for cooling and lubricating the tools during metal cutting and metal forming. The most important processing operations are differentiated by the type of movements made by the processed part and the tool, by the geometry of the parts being produced and the processing conditions. One distinguishes, for example, milling, turning, drilling and grinding as being cutting processes, and rolling, deep drawing and cold extrusion as being deformations without cutting.

The common principle of the metal-cutting processes is that the cutting edge of the tool cuts into the material and in doing so removes a splinter from the surface, so that a new surface is formed. Very high pressures are required for cutting into the material. The deformation of the splinter and the friction produced under the pressure produce heat, which heats the workpiece, the tool and, above all, the splinters.

The required effect of using cooling lubricants is therefore the lowering of the temperature, which otherwise may rise, for example, up to 1000° C. in the splinters and which affects the dimensional accuracy of the parts produced. Another major task of the cooling lubricant is to extend the useful life of the tools, which wear rapidly under the influence of elevated temperatures. The roughness of the surfaces is decreased by the use of a cooling lubricant, as the lubricant prevents welding of the tool and the surface of the workpiece and avoids adhesion of particles. Moreover, the cooling lubricant assumes the task of transporting away the splinters formed.

A clear definition of cooling lubricants has been established in the revised version of DIN 51385 No. 1, the items in question being cooling lubricants which are immiscible with water, water-miscible and mixed with water. According to DIN 51385, the term "mixed with water" refers to the fmal condition of the prepared medium (in most cases oil-in-water emulsions), but "water-miscible" refers to the condition of the concentrate.

Cooling lubricants mixed with water are prepared on the user's premises by mixing together a concentrate of the water-miscible cooling lubricant and tap water. Generally ca. 5% aqueous emulsions are prepared. The advantage of this type of cooling lubricant is the good cooling action, which is due to the thermal properties of the water. As a result of the good cooling action, it is possible to achieve very high operating speeds and thereby to increase the productivity of the machines. The lubricating action of the cooling lubricants mixed with water is adequate for most processing methods involving cutting. A further advantage lies in the low costs, which are achieved owing to the feasibility of mixing the concentrate with water. A disadvantage of cooling lubricants mixed with water is that they are susceptible to external influences, in particular to attack by microorganisms, and therefore require more control and care than do cooling lubricants which are immiscible with water, such as cutting oils, grinding oils and forming oils.

The Table below provides a summary of the requirements for cooling lubricants which are water-miscible and for those which are mixed with water:

cooling and lubricating action
rust protection
no attack on non-ferrous metals
toxicological safety, in particular skin tolerance
no foam formation
no attack on paints and seals
emulsion stability
no agglutination or resinification
good miscibility
pleasant aroma
clean appearance
good filterability
trouble-free disposal.

A survey of the processes for forming metals and of the auxiliaries conventionally used for this purpose may be found, for example, in *Ullmann's Encyclopaedia of Industrial Chemistry,* 5th Ed., Vol. A15, 479–486. The range of the available forms of the suitable auxiliaries extends from oils, via oil-in-water emulsions, to aqueous solutions.

Cooling lubricants which are immiscible with water and those which are water-miscible are frequently based on mineral oil. The grades of mineral oils used are predominantly combinations of paraffinic, naphthenic and aromatic hydrocarbon compounds. Besides the mineral oils, so-called synthetic lubricants ("synthetic oils"), such as polyalpha olefins, polyalkylene glycols and polyalkylene glycol ethers, dialkyl ethers, acetals, natural ester lubricants, as well as synthetic esters and derivatives thereof are also important.

To be capable of fulfilling the requirements in practice, cooling lubricants must contain various components in addition to the oil base. The most important groups of substances are the emulsifiers, anti-corrosion additives, biocides, EP additives, polar additives, antifogging additives, antioxidants, solid lubricating additives and defoaming agents.

Emulsifiers (for example, surfactants, petroleum sulfonates, alkali soaps, alkanolamine soaps) stabilise the fine distribution of oil droplets within the aqueous operating liquid, which is an oil-in-water emulsion. The emulsifiers are quantitatively an important group of additives for the water-miscible cooling lubricants.

Conventional anti-corrosion additives (for example, alkanolamines and salts thereof, sulfonates, organic boron compounds, fatty acid amides, aminodicarboxylic acids, phosphate esters, thiophosphonic esters, dialkyldithiophosphates, monoalkylaryl sulfonates and dialkylaryl sulfonates, benzotriazoles, polyisobutene succinic acid derivatives) are intended to prevent the rusting of metal surfaces. Some anti-corrosion additives simultaneously have emulsifying properties and are therefore also used as emulsifiers. Biocides (for example, phenol derivatives, formaldehyde derivatives, "Kathon MW") are intended to inhibit the growth of bacteria and fungi. EP additives (for example, sulfurised fats and oils, phosphorus-containing compounds, organochloro compounds) are intended to prevent microwelding between metal surfaces at high pressures and elevated temperatures. Polar additives (for example, natural fats and oils, synthetic esters) increase the lubricating properties.

Antioxidants (for example, organic sulfides, zinc dithiophosphates, aromatic amines) ensure that the cooling lubricants have a long-pot life.

In addition to the cooling action, the second important function of cooling lubricants is the lubricating action (see the article by W. Klose: "Kühlschmiermittel auf Metalloberflächen", Mitteilungen des Vereins Deutscher Emailfachleute, 41, Number 11, pages 138–142 (1993)). According to this, the action of the lubricating components depends on the formation of surface layers which possess a lower shear strength than that of the underlying material and therefore reduce friction and wear. The range of surface conditions extends from adsorptively bonded layers, via chemisorption, to chemically reactive layers, which produce a strong bond to the metal surface.

Adsorptive lubricating films are the simplest form of lubricating covering on a surface. They are produced, for example, by mineral oils without specialised additives. The formation of the adsorbed layers may be promoted by additions of polar active substances, such as fatty alcohols or fatty esters. Here, over and above the purely physical adsorption, there occurs an interaction between the metal surface and the molecules of the lubricant, which results in a partial chemisorptive bonding of the fatty alcohol or of the fatty ester.

Fatty acids are typical examples of chemisorptive lubricating layer formers. The hydrophilic carboxyl group is chemically bonded to the metal surface by reaction with the metal atoms and the hydrophobic hydrocarbon group is aligned vertically to the surface. The increased adhesive strength of the chemisorptive layer improves the capacity to absorb pressure compared with that of purely adsorptive lubricating films, but, in many cases of metal forming, is still not sufficient to reduce friction and wear. Here only admixtures of EP or AW additives (extreme pressure or antiwear additives) bring about an adequate improvement in the lubricating performance, so that even complex forming processes are rendered possible. These additives are generally active substances containing chlorine, phosphorus or sulfur. The action thereof depends on the development of chemically reactive layers in the form of metal chlorides, metal phosphates or metal sulfides. For reasons of disposal, nowadays endeavours are made to dispense with chlorine-containing EP additives if possible. The reactive layers formed at the metal surface act, on the one hand, as solid lubricating films, which are constantly worn away and renewed during the forming process. On the other hand, they form monomolecular surface films, which may take up additional lubricating components.

Cooling lubricants mixed with water are a common type of cooling lubricant. In practice, however, different cooling lubricants mixed with water are used in order to satisfy the different requirements with regard to corrosion protection of the various materials processed, lubricating action at high operating speed, pot-life and, not least, industrial safety provisions and environmental requirements. Many different types of cooling lubricant concentrates have therefore to be produced, stored and transported in small batches by the manufacturers of these substances. At the user's premises, emulsions which are still usable may have to be discarded, if another type of cooling lubricant becomes necessary because of a change in materials. These processes are cost-intensive and disadvantageous from the environmental aspect.

There is accordingly a need for a new cooling lubricant emulsion of the type mixed with water, which may be used for an extended range of applications. Such a new type of cooling lubricant is made available through the finding that it is possible, by the application of high shear energy, to emulsify a natural cutting oil which is immiscible with water in a conventional per se cooling lubricant emulsion mixed with water, and thereby to obtain a stable oil-in-water emulsion. Such a combination of at least two oil components may be used for a wide range of applications.

DESCRIPTION OF THE INVENTION

One embodiment of the present invention accordingly relates to a process for the preparation of a cooling lubricant emulsion for the cutting of metals, wherein:

(a) from 2 to 15 parts, by weight, of a water-miscible concentrate of a cooling lubricant emulsion is mixed with from 98 to 85 parts, by weight, of water, in order to obtain a mixture containing 100 parts, by weight; and, subsequently, (b) from 1 to 14 parts, by weight, of a natural cutting oil which is immiscible with water is dispersed in the mixture (a) by means of strong shearing.

Here it is preferable to use fewer parts, by weight, of cutting oil immiscible with water than parts, by weight, of water-miscible concentrate. The proportions of cutting oil to the proportions of water-miscible concentrate are preferably, for example, between 10 and 80 to 100 and in particular, for example, between 20 and 70 to 100.

Therefore, the present invention mainly involves, contrary to the usual instructions in practice, the dispersion of a natural cutting oil which is per se immiscible with water in a conventional per se cooling lubricant emulsion. For this a shear energy is required which is high compared with the prior art for preparing cooling lubricant emulsions mixed with water. The required shearing may be produced, for example, by stirring with a toothed disc. Alternatively, intensive mixers, such as an Ultraturrax (rate of rotation 10,000 to 20,000 revolutions per minute) or high-rotating rotor-stator systems are suitable. Where an Ultraturrax is used, dispersion is achieved by 20,000 revolutions per minute for a period of from about 1 to about 5 minutes. An alternative to this, available during the operation, involves introducing the cutting oil into the operating system at a point where turbulence is high. The dispersion then takes place as a result of the shear forces during the metal processing operations.

The individual components here are well-known as cooling lubricants or as concentrates for cooling lubricant emulsions in prior art. For example, in step (a) one may use an emulsion concentrate which consists of about 20 to about 60 wt. % of an oil component, preferably ester lubricant, but also contains paraffinic or naphthenic mineral oil, which may if desired contain lubricating additives, and from 0 to 25 wt. % of water. The remainder, bringing the total to 100 wt. %, comprises emulsifiers, preferably based on fatty alcohol ethoxylates, corrosion inhibitors, preferably based on alkali metal carboxylates, amine soaps, ethanolamine soaps and/or ethanolamides, and optionally other auxiliary and active substances known in the prior art for this group of products, for instance, those listed in the concentrates given as Examples.

Synthetic oils, for example polyolefms, may be used instead of the mineral oil. Acetals or dialkyl ethers are alternative oil components having increased biodegradability.

For example, the concentrate used in step (a) may be a water-miscible cooling lubricant emulsion consisting of (data in wt. %):

| Concentrate 1 | |
|---|---|
| 57% | mineral oil |
| 16.5% | $C_{14}$–$C_{20}$ fatty acid mixture |
| 4.4% | potassium hydroxide solution, 45% |
| 5.5% | alkylsulfonamide carboxylic acid |
| 7.0% | hexanediol |
| 4.0% | petroleum sulfonate |
| 0.4% | triazole derivative |
| 3.0% | hexahydrazine derivative |
| 0.2% | o-phenylphenol |

Remainder: demineralised water

| Concentrate 2 | |
|---|---|
| 35% | mineral oil |
| 7.5% | $C_{14}$–$C_{20}$ fatty acid mixture |
| 11.5% | $C_{32}$–$C_{36}$ dimeric fatty acid mixture |
| 8.0% | $C_6$–$C_9$ carboxylic acid mixture |
| 12.5% | potassium hydroxide solution, 45% |
| 17.0% | ethoxylated fatty alcohol (2 to 5 ethylene oxide groups) |
| 3.0% | hemiacetal |
| 0.3% | Na pyrion |

Remainder: demineralised water

| Concentrate 3 | |
|---|---|
| 35.5% | mineral oil |
| 6.5% | $C_{14}$–$C_{20}$ fatty acid mixture |
| 7.0% | boric acid |
| 3.0% | $C_6$–$C_9$ carboxylic acid mixture |
| 11.0% | mixture of primary and tertiary alkanolamines |
| 8.5% | fatty acid amide |
| 8.5% | ethoxylated fatty alcohol (2 to 5 ethylene oxide groups) |
| 1.0% | butyl diglycol |
| 0.2% | Na pyrion |

Remainder: demineralised water

In step (b), ester-based oils are used as cutting oils immiscible in water. Examples of these are natural triglycerides or modification products thereof, waxy esters and fatty acid esters of monoalkanols having 4 to 12 carbon atoms, for example, the ethylhexyl ester of tallow fatty acid, or transesterified rape-seed oil, as well as fatty acid esters of polyols, wherein trimethylolpropane in particular may be used as polyol component. Mixtures of these oils may also be used in step (b). The oils may contain additional auxiliary substances; examples of these which may be particularly mentioned are EP additives, for example, in the form of sulfurised compounds, antioxidants and corrosion inhibitors. The cutting oil which is immiscible in water is preferably selected from oxidation-stabilised fatty acid glycerides in the form of triesters containing three fatty acids having 14 to 22 carbon atoms per fatty acid molecule and oxidation-stabilised diesters containing two fatty acids having 12 to 22 carbon atoms per fatty acid molecule.

Another embodiment of the present invention relates to a ready-to-use cooling lubricant emulsion mixed with water, of the oil-in-water type, which may be prepared directly at the user's premises by means of the process described above. The emulsion could also be prepared centrally and be transported to the individual users. This is uneconomic and disadvantageous environmentally, as it would necessarily involve the transport of large quantities of water.

For the preparation of the emulsion according to the present invention, it is not necessary to carry out the steps (a) and (b) in immediate succession. Rather, a user of a conventional cooling lubricant emulsion may also carry out part (b) of the present invention by subsequently dispersing, in the manner described in more detail above, a cutting oil in this emulsion after it has already been put into use.

The present invention also relates to the use of the present cooling lubricant emulsion for the cutting of metals. Examples of such cutting processes are milling, turning, drilling, grinding and lapping.

The emulsions according to the present invention may be employed for a wide range of uses and result in better values for abrasive wear than those of conventional emulsions without the addition of a natural cutting oil which is immiscible in water. They also bring about an improved protection from corrosion. In micrographs obtained using a scanning electron microscope, they appear as a "two-phase lubricant" containing a finely emulsified O/W emulsion and a coarsely dispersed cutting oil. The sizes of the actual droplets depend upon the shearing conditions and may therefore vary. The ranges of the droplet sizes overlap, however, so that in particle size determinations by light scattering methods, for example, using a Sympatec Helios Vectra apparatus, as a rule only one distribution maximum is obtained. This is preferably in the range between about 0.5 and about 8 $\mu$m, in particular between about 1 and about 4 $\mu$m. The particle size can also be determined by means of a light microscope or a video microscope.

The ready-to-use cooling lubricant emulsion mixed with water is thus characterised in that it is an oil-in-water emulsion wherein more than 95% of the oil particles are smaller than 0.5 $\mu$m and into which the cutting oil which is immiscible in water is dispersed to such a degree that it is present to the extent of at least 50% in the form of particles having sizes within the range of 0.5 to 8 $\mu$m.

EXAMPLES

For tests of suitability, the concentrates 1 and 3 specified above were used as water-miscible concentrates according to step (a). The parts, by weight, of concentrate given in the Table below were stirred by means of a glass rod into the number of parts, by weight, of water (having a water hardness corresponding to 20° Deutsche Härte [= German hardness]) appropriate to produce 100 parts, by weight, of a conventional cooling lubricant emulsion. The comparison experiments 1*a* and 1b and also 3*a* and 3*b* were carried out using these emulsions.

Cooling lubricant emulsions according to the present invention were obtained by emulsifying 2 parts, by weight, of a natural ester-based cutting oil in the emulsion as in 1*a*, and 1 part, by weight, of a natural ester-based cutting oil in the emulsion 3*a*. The cutting oil consisted of a mixture of oxidation-stabilised fatty acid glycerides in the form of triesters containing three fatty acids having 14 to 22 carbon atoms per fatty acid molecule and oxidation-stabilised diesters containing two fatty acids having 12 to 22 carbon atoms per fatty acid molecule ("P3 Multan® 201", Henkel KGgA, Düsseldorf). To this end, the cutting oil was added to the emulsion mixed with water and dispersed by means of an Ultraturrax for 1 minute at 20,000 revolutions per minute.

A test of abrasive wear by Reichert's method was carried out as a test of suitability. This method is used for the determination of the capacity to absorb pressure (EP behavior) and for the determination of the adhesive strength of liquid lubricants. Here a test roll is accommodated by means of a system of levers on a circulating slip ring, the lower third part whereof dips into the lubricant being tested.

Before the beginning of the test the test roll, which has been cleaned in special boiling-point spirit, is introduced into the rotatable holding device. The holding device is rotated into position and clamped. The slip ring remains clamped in the device for several tests, where it is again cleaned with special boiling-point spirit after each test. The test roll is brought onto the slip ring by slow application of the loading weight (1.5 kg). The counter positioned on the Reichert balance is set to 0. The motor is switched on and this causes the rotating slip ring, which is immersed in the lubricant, to supply the point of contact continuously with lubricant. When the number 100 on the counter has been reached (100 metres friction distance) the test roll is removed from the slip ring. The test roll is disassembled and the abrasion marks which have formed are measured by means of a measuring microscope. The elliptical surface is calculated from the relation 0.785*length*breadth, or is read off from a numerical table. The tests are carried out repeatedly until the elliptical surfaces from the final three tests differ from one another by not more than 10%. The capacity to absorb pressure is the greater, the smaller the elliptical surface determined.

| | Results | | |
|---|---|---|---|
| Test emulsion | Parts, by weight Concentrate | Parts, by weight Cutting Oil | Abrasive wear |
| 1a (comparison) | 5 | — | 33 $m^2$ |
| 1b (comparison) | 7 | — | 30 $mm^2$ |
| 1c (according to the present invention) | 5 | 2 | 18 $mm^2$ |
| 3a (comparison) | 3 | — | 31 $mm^2$ |
| 3b (comparison) | 5 | — | 30 $mm^2$ |
| 3c (according to the present invention) | 3 | 1 | 15 $mm^2$ |

What is claimed is:

1. A process for preparing a cooling lubricant emulsion useful for the cutting of metals comprising the steps of:

(a) forming a mixture comprising an oil component, water and an emulsifier, wherein the oil component is emulsified in the water to form a mixture which is an oil-in-water emulsion and in which mixture more than about 95 percent of oil particles have sizes that are smaller than about 0.5 $\mu$m; and (b) dispersing by means of high shear in said mixture, from about 1 to about 14 parts by weight of a natural, water-immiscible cutting oil per 100 parts by weight of said mixture such that at least 50 percent by weight of said cutting oil is in the form of particles having sizes within the range of about 0.5 to about 8 $\mu$m to form said cooling lubricant emulsion.

2. The process of claim 1 wherein the mixture in step (a) is formed by mixing 2 to 15 parts by weight of a water-miscible lubricant emulsion concentrate with 85 to 98 parts by weight of water to form 100 parts by weight of said mixture.

3. The process of claim 1 wherein the weight ratio of the oil component of the mixture formed in step (a) and the cutting oil is from 10:1 to 10:8.

4. The process of claim 2 wherein the cooling lubricant emulsion concentrate comprises 20 to 60 percent by weight of said oil component and 0 to 25 percent water.

5. The process of claim 1 wherein the oil component of the mixture formed in step (a) comprises an aliphatic or naphthenic mineral oil, an ester lubricant, a polyolefin, or an acetal or a dialkyl ether.

6. The process of claim 1 wherein the cutting oil comprises one or more ester-based oils selected from the group consisting of natural triglycerides or products thereof, waxy esters, fatty acid esters of monoalcohols having 4 to 12 carbon atoms, and fatty acid esters of polyols.

7. The process of claim 1 wherein the cutting oil comprises an oxidation-stabilized fatty acid glyceride in the form of a triester containing three fatty acids having 14 to 22 carbon atoms per fatty acid molecule or an oxidation-stabilized diester containing two fatty acids having 12 to 22 carbon atoms per fatty acid molecule.

8. The process of claim 1 wherein the cutting oil is dispersed into the mixture after said mixture has been put into use.

9. A cooling lubricant emulsion for the cutting of metals comprising:

(a) a mixture comprising an oil component, water and an emulsifier wherein the oil component is emulsified in the water; and (b) 1 to 14 parts by weight of a natural, water-immiscible cutting oil dispersed in 100 parts by weight of said mixture, wherein at least 50% of the cutting oil is present in the form of particles having diameters of 0.5 to 8 micrometers.

10. The cooling lubricant emulsion of claim 9 wherein the weight ratio of the oil component and the cutting oil is from 10:1 to 10:8.

11. The cooling lubricant emulsion of claim 10 wherein the weight ratio of the oil component and the cutting oil is from 10:2 to 10:7.

12. The cooling lubricant emulsion of claim 10 wherein the oil component comprises an aliphatic or naphthenic mineral oil, an ester lubricant, a polyolefin, an acetal or a dialkyl ether.

13. The cooling lubricant emulsion of claim 9 wherein the cutting oil is an ester-based oil selected from the group consisting of natural triglycerides or products thereof, waxy esters, fatty acid esters of monoalcohols having 4 to 12 carbon atoms, and fatty acid esters of polyols.

14. The cooling lubricant emulsion of claim 12 wherein the cutting oil comprises an oxidation-stabilized fatty acid glyceride in the form of a triester containing three fatty acids having 14 to 22 carbon atoms per fatty acid molecule or an oxidation-stabilized diester containing two fatty acids having 12 to 22 carbon atoms per fatty acid molecule.

15. A method of cutting a metal surface comprising the steps of applying the cooling lubricant emulsion of claim 9 to said metal surface and cutting said metal surface.

* * * * *